US006612769B2

(12) United States Patent
Lee et al.

(10) Patent No.: US 6,612,769 B2
(45) Date of Patent: Sep. 2, 2003

(54) PACKAGE AND DISPENSING ACTUATOR FOR MULTIPLE-COMPONENT COMPOSITIONS

(75) Inventors: Robert Lee, Lake Elmo, MN (US); Dale D. Peterson, Maplewood, MN (US); Brian A. Shukla, St. Paul, MN (US)

(73) Assignee: Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/736,602

(22) Filed: Dec. 13, 2000

(65) Prior Publication Data

US 2002/0122685 A1 Sep. 5, 2002

(51) Int. Cl.[7] ..... B43M 11/06

(52) U.S. Cl. ..... 401/183; 401/123; 401/118; 206/219; 222/145.5

(58) Field of Search ..... 401/40, 41, 42, 401/183, 184, 185, 118, 123; 366/177.1, 336–338, 181.6; 206/219; 222/145.1, 145.5

(56) References Cited

U.S. PATENT DOCUMENTS 3,713,779 A * 1/1973 Sirago et al. ..... 23/259
4,997,083 A * 3/1991 Loretti et al. ..... 206/219
6,105,761 A 8/2000 Peuker et al.

FOREIGN PATENT DOCUMENTS

| | | |
|---|---|---|
| DE | 73 34 132 | 7/1977 |
| DE | 196 12 965 | 10/1997 |
| JP | 05220366 | 8/1993 |

* cited by examiner

*Primary Examiner*—David J. Walczak
(74) *Attorney, Agent, or Firm*—James D. Christoff

(57) ABSTRACT

A package for a multiple-component composition includes a first sheet and a second sheet connected to the first sheet, and at least one of the sheets is made of a flexible material. At least two storage chambers and a mixing chamber are located between the sheets and interconnected by passageways. In certain embodiments, the mixing chamber is located between the passageways. In some embodiments, the passageways are spaced from each other. Compressing the storage chamber directs components in the respective chambers into the mixing chamber for subsequent dispensing as needed. Optionally, an actuator is provided and has a channel for receiving the package. As the package moves through the channel, the storage chambers are compressed and the components in the storage chamber are directed to the mixing chamber.

41 Claims, 6 Drawing Sheets

PACKAGE AND DISPENSING ACTUATOR FOR MULTIPLE-COMPONENT COMPOSITIONS

BACKGROUND OF THE INVENTION

1. Field of the Invention

This invention relates to a package for containing and dispensing compositions that are made with two or more initially separate components. This invention also relates to an assembly that includes a package for a multiple-component composition along with a dispensing actuator for facilitating the mixing of the components.

2. Description of the Related Art

A number of liquid and semi-liquid compositions are made from two or more components that are typically not mixed together until immediately prior to use. For example, certain adhesives such as epoxies are sold in packages that initially keep components of the adhesive separated from each other. Whenever such adhesives are needed for use, the components are mixed together and a chemical reaction between the two components begins. After the components are mixed, the composition is applied to the work site before the composition unduly hardens.

A number of packages have been proposed over the years for separately containing and storing components of multiple-component compositions. An example of one type of commonly-used package for multiple-component compositions is a dual-chamber cartridge that is adapted to fit within a dispensing applicator. The cartridge includes a piston in each chamber, and the applicator typically includes a pair of side-by-side plungers that are adapted to simultaneously apply pressure to both pistons in order to direct components from both chambers at the same time.

Examples of dual-chamber dispensing syringes are described in U.S. Pat. Nos. 5,722,829, 5,624,260, and 4,538,920. In many instances, a static mixer is connected to the outlets of the cartridge for facilitating mixing of the components as the components are directed from the chambers. Often, the plungers of the applicator are connected to a lever so that a mechanical advantage is provided and relatively viscous components can be directed from the chambers and through the static mixer without undue effort.

Unfortunately, dual-chamber cartridges, static mixer and applicator assemblies are not entirely satisfactory for dispensing multiple-component compositions in some instances, particularly in instances where only a relatively small amount of composition is needed. In those instances, large portions of the components may remain in the cartridge after a sufficient amount has been taken for the work at hand. It may be possible to replace the static mixer with a new static mixer and use the remaining portions of the components at a later date, but the components may degrade in the interim.

Moreover, when dual-chamber cartridges are used in health care fields such as dentistry, the user must take care to avoid cross-contamination between patients in offices where the composition from a single cartridge is used in multiple procedures among different patients. The issue of cross-contamination can be addressed by proper handling of the dispensing assembly to ensure that disinfection of the cartridge, applicator and static mixer assembly is accomplished as needed. However, inadequate attention to proper disinfection and handling techniques of the assembly may increase the risk of transferring an infectious disease from one patient to another.

Multiple-component compositions have also been sold in the past in separate bulk containers such as jars or vials. When a quantity of those compositions is needed, the user withdraws a portion of the components from each container using, for example, an applicator brush, swab, spatula or other hand instrument, or by pouring the components from the containers directly onto a mixing pad or mixing well. In this procedure, it is common practice to mix the components together using the hand applicator before applying the mixed composition to the intended location.

However, the use of bulk containers is also not entirely satisfactory. For one thing, it is sometimes difficult to withdraw the desired amount of component from each container in correct proportions. For another thing, it is possible that a user may unintentionally dip the applicator in the second container after the applicator has been placed in the first container and as a result contaminate the contents of the second container. Furthermore, the amount of the components supplied in the bulk containers may be far greater than needed for a particular job, and the remainder of the components may be wasted or degrade over a period of time.

As a result of the foregoing, single use packages have been developed for storing and dispensing of multiple component compositions. Such packages may be formed, for example, by sheets of flexible material having initially separate chambers that receive the components. When the composition is needed, the flexible sheets are squeezed together to decrease the volume in the chambers and direct the components along a path for mixing and dispensing.

Examples of packages that may be used to store and dispense relatively small amounts of multiple component compositions are described in U.S. Pat. Nos. 4,331,264 and 4,952,068. Both of these references describe packages where the components are mixed together in an area downstream of the storage chambers. Canadian patent application no. 2,244,628 also describes a package for dispensing compositions, and includes a pocket for receiving a brush that may be used to apply the mixed composition to an application site.

However, there is a continuing need in the art to improve upon existing packages for multiple-component compositions. For example, there is a demand for an improved package that assures that essentially all of the components are mixed together, so that the correct proportion of the components is present in the resulting mixture. Moreover, there is a need for a package that is relatively easy to manufacture and yet reliably functions to mix and dispense the composition when needed.

SUMMARY OF THE INVENTION

The present invention is directed in one aspect to a package for a multiple-component composition that comprises a first sheet and a second sheet connected to the first sheet. At least one of the sheets is made of a flexible material. The package also includes a first chamber, a second chamber and a mixing chamber. Each of the chambers is located between the first sheet and the second sheet. The package also includes an outlet passageway connected to the mixing chamber. The package further includes a first passageway extending from the first chamber to the mixing chamber, and a second passageway extending from the second chamber to the mixing chamber. The mixing chamber is located along a reference axis that extends between the first passageway and the second passageway.

The present invention is also directed in another aspect to a package for a multiple-component composition. In this aspect, the package includes a first sheet and a second sheet connected to the first sheet. At least one of the sheets is made of a flexible material. The package also includes a first chamber, a second chamber and a mixing chamber. Each of the chambers is located between the first sheet and the second sheet. The package includes an outlet passageway connected to the mixing chamber. The package also includes a first passageway extending from the first chamber to the mixing chamber and a second passageway extending from the second chamber to the mixing chamber. The first passageway and the second passageway are spaced apart from each other.

Another aspect of the present invention is also directed toward a package for a multiple-component composition. The package in this aspect includes a first sheet and a second sheet connected to the first sheet in overlying relation. At least one of the sheets is made of a flexible material. The package also includes a first chamber, a second chamber and a mixing chamber. Each of the chambers is located between the first sheet and the second sheet. The package also includes a first passageway connecting the first chamber to the mixing chamber, and a second passageway connecting the second chamber to the mixing chamber. An outlet passageway extends from the mixing chamber and a vent passageway extends from the outlet passageway to the atmosphere. At least one of the first sheet and the second sheet includes a line of weakness that extends along a path between the vent passageway and the outlet passageway. The vent passageway has a cross-sectional area that is less than the cross-sectional area of the outlet passageway.

An additional aspect of the present invention is also directed to a package for a multiple-component composition. In this aspect, the package includes a first sheet and a second sheet connected to the first sheet in overlying relation. At least one of the sheets is made of a flexible material. The package includes a first chamber, a second chamber and a mixing chamber, and each of the chambers is located between the first sheet and the second sheet. The package also includes a first passageway connecting the first chamber to the mixing chamber, and a second passageway connecting the second chamber to the mixing chamber. A first component is received in the first chamber, and a second component is received in the second chamber. At least one of the first sheet and the second sheet is stretched past its yield point in areas next to the mixing chamber and is also initially collapsed in at least some of the same areas when the first component and the second component are received in the first chamber and the second chamber respectively, in order to facilitate passage of the first component and the second component along the first passageway and the second passageway respectively and into the chamber.

The present invention is also directed to a dispensing assembly. The assembly includes a package for a multiple-component composition that includes a first sheet and a second sheet connected to the first sheet in overlying relation. At least one of the sheets is made of a flexible material. The package also includes a first chamber, a first component received in the first chamber, a second chamber, a second component received in the second chamber and a mixing chamber. Each of the chambers is located between the first sheet and the second sheet. The package also includes a first passageway connecting the first chamber to the mixing chamber, a second passageway connecting the second chamber to the mixing chamber and an outlet passageway connected to the mixing chamber. The assembly also includes an actuator that comprises a body with a channel for receiving the package. The body includes wall sections for compressing the first chamber and the second chamber as the package is received in the channel in order to direct the first component and the second component into the mixing chamber.

The present invention is also directed to a method of making a composition from two or more components. The method includes providing a package having at least two chambers and at least two components received in respective chambers, and placing the package in a channel of an actuator. The method also includes moving the package along the channel in order to compress at least one chamber and to direct the respective component along a path for contact with the other component.

The package, dispensing assembly and method of the invention are particularly useful for facilitating dispensing of substantially all of the components in the chambers when needed. As a consequence, the proportion of the components in the resulting composition is essentially the same proportion as intended by the manufacturer, such that the characteristics of the resulting composition can be predicted with relative certainty. The package and assembly of the invention are relatively easy to manufacture and use, and are particularly suitable for use in the field of dentistry to dispense a single dose of dental composition for a single patient. However, the invention is also useful for compositions adapted for household, industrial, commercial, construction and marine applications as well.

These and other features of the invention are described in the paragraphs that follow and are illustrated in the accompanying drawings.

DETAILED DESCRIPTION OF THE PREFERRED EMBODIMENTS

Figure 1:
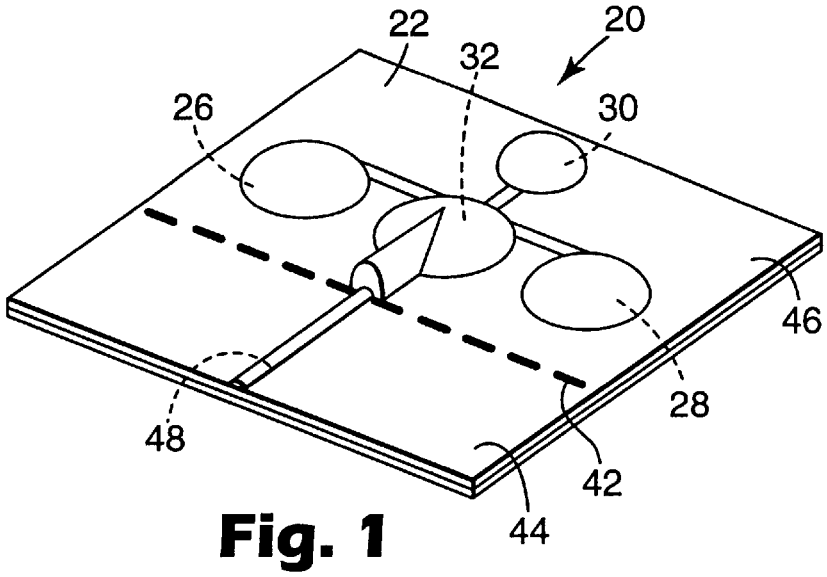
FIG. 1 is a top, front and right side perspective view of a package for a multiple-component composition according to one embodiment of the invention.
Figure 2:
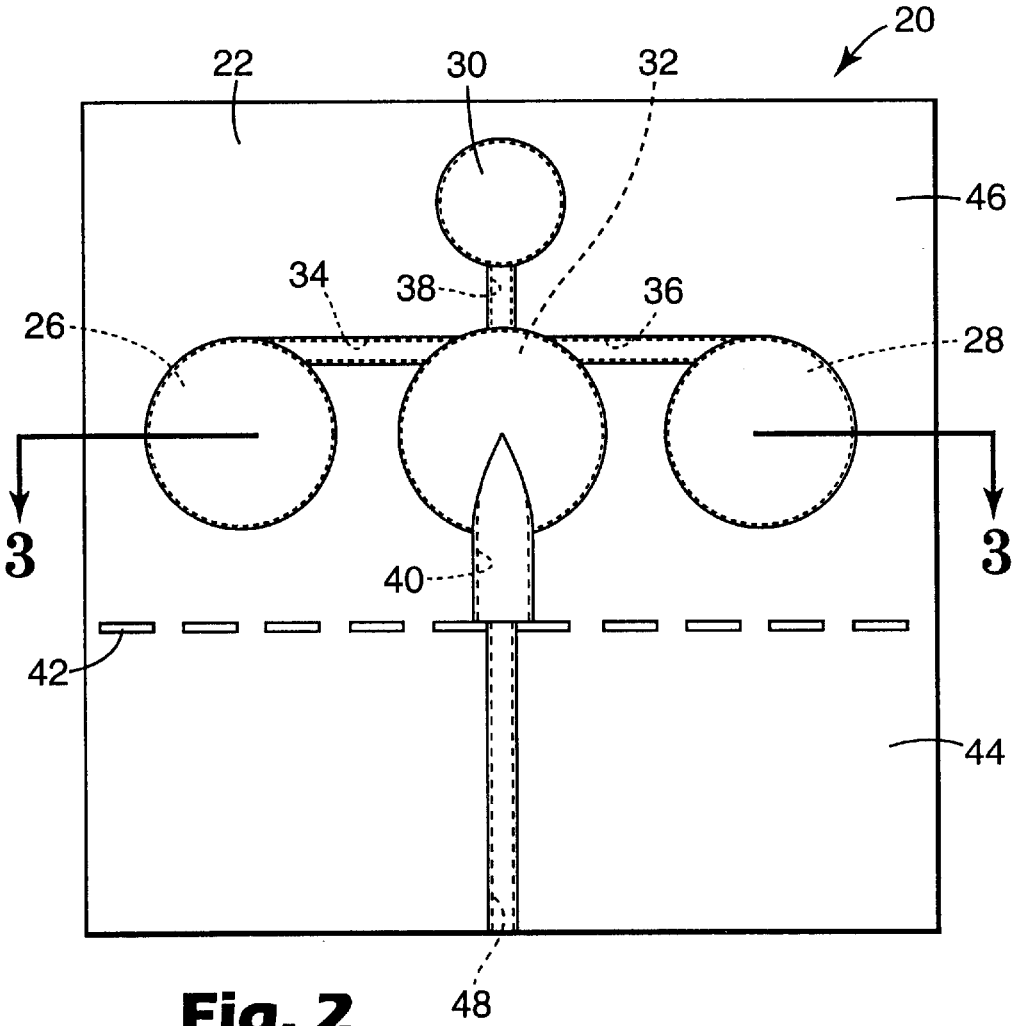
FIG. 2 is an enlarged plan view of the package shown in FIG. 1.
Figure 3:
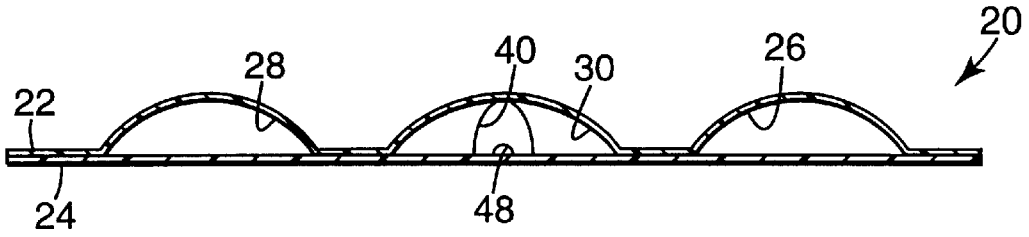
FIG. 3 is a cross-sectional view of the package shown in FIGS. 1 and 2 and taken along lines 3—3 of FIG. 2.
Figure 4:
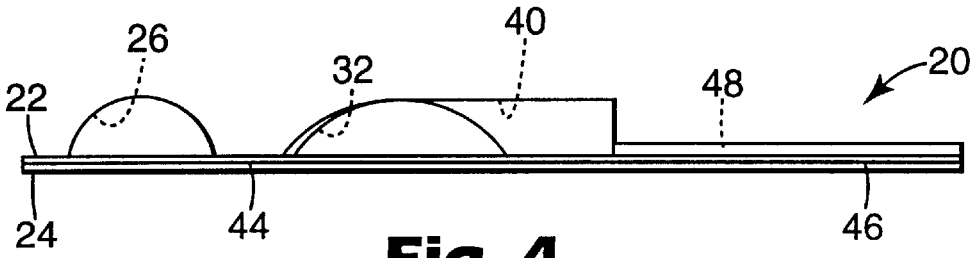
FIG. 4 is a left side elevational view of the package shown in FIGS. 1–3.

A package for a multiple-component composition is shown alone in FIGS. 1–4 and is broadly designated by the numeral 20. The package 20 includes a first, top sheet 22 (FIGS. 1–4) and a second, bottom sheet 24 (FIGS. 3 and 4). In plan view, both of the sheets 22, 24 preferably have perimeters that are identical in shape, although other constructions are also possible.

The top sheet 22 extends over the bottom sheet 24 and is fixed to the bottom sheet 24. At least one of the sheets 22, 24 is made of a flexible material. Preferably, both of the sheets 22, 24 are made of a flexible material that can be deformed by finger pressure.

The package 20 includes a first storage chamber 26, a second storage chamber 28 and a third storage chamber 30. The package 20 also includes a mixing chamber 32. Each of the chambers 26–32 is located between the top sheet 22 and the bottom sheet 24. Each of the chambers 26–32 has a circular configuration in plan view as shown in FIG. 3, but other shapes are also possible. For example, any or all of the chambers 26–32 could have an oval-shaped configuration in plan view.

The package 20 includes a first passageway 34 that extends between the first storage chamber 26 and the mixing chamber 32. A second passageway 36 extends between the second storage chamber 28 and the mixing chamber 32. Additionally, a third passageway 38 extend between the third storage chamber 30 and the mixing chamber 32. Each of the passageways 34, 36, 38 is elongated and is located between the top sheet 22 and the bottom sheet 24.

The package 20 also includes an outlet passageway 40 that begins at the mixing chamber 32 and extends toward the front edge of the package 20. The outlet passageway 40 ends at a location that is on or closely adjacent a line of weakness 42 that extends between the left side and the right side of the package 20. The line of weakness 42 defines a boundary between a front portion 44 (FIGS. 1 and 2) of the package 20 and a rear portion 46 of the package 20.

The line of weakness 42 may be made by any one of a number of well-known manufacturing techniques. In the illustrated embodiment, the line of weakness 42 is constructed by making a spaced apart perforations that extend through both of the sheets 22, 24. The perforations preferably do not extend into the outlet passageway 40, but could extend into the outlet passageway 40 and optionally serve as a vent (either in addition to or as a substitute for the vent passageway 48 described below).

Other constructions for the line of weakness 42 are also possible. For example, the line of weakness may be made by perforating only one of the sheets 22, 24. As additional alternatives, the line of weakness 42 may be made by scoring, by making a groove, or by otherwise weakening the material of either one or both of the sheets 22, 24 along a path next to the front portion 44 of the package 20. Moreover, one or both of the sheets 22, 24 may be made of an oriented film that is arranged so that it tears most readily in a direction parallel to the line of weakness 42 shown in the drawings.

The package 20 also includes a vent passageway 48 that extends from the forward end of the outlet passageway 40 to the front edge of the package 20. Preferably, the cross-sectional area of the vent passageway 48 is smaller than the cross-sectional area of the outlet passageway 40 when considered in reference planes perpendicular to the longitudinal axis of the vent passageway 48.

In the embodiment shown in FIGS. 1–4, the passageways 34, 36 are located on opposite sides of the mixing chamber 32 and extend in opposite directions toward the mixing chamber 32. The passageways 34, 36 have a generally constant width along the length. Also, the chambers 26, 28 are symmetrically disposed on opposite sides of the central mixing chamber 32. Such an arrangement is advantageous, in that reliable passage of the components to the mixing chamber 32 and consistent mixing of the components in the mixing chamber 32 can be assured. Furthermore, backflow of the components, as might be observed if the storage chambers were arranged in series with a mixing or reservoir chamber, is avoided. In addition, the third storage chamber 30 is aligned with a reference axis that passes through the middle of the mixing chamber 32 as well as along a central axis of the outlet passageway 40 and the vent passageway 48. However, numerous other arrangements of the chambers 26–32 and the passageways 34–40 and 48 are also possible.

Although not shown in the drawings, a first component of a multiple-component composition is received in the first storage chamber 26 and a second component of the same composition is received in the second storage chamber 28. The third storage chamber 30 is optional and may be omitted if desired. If the third storage chamber 30 is provided as shown in FIGS. 1–4, a third component of the multiple-component composition is received in the third storage chamber 30. As another option, a third component of the composition may be initially contained in the mixing chamber 32 and the third storage chamber 30 in that instance could be omitted.

The storage chamber 26 is sealed around its entire periphery, including an initial seal that extends across the entrance to the first passageway 34. When pressure is exerted on the first storage chamber 26 to collapse the chamber 26, internal pressure in the chamber 26 will cause the initial seal across the entrance to the first passageway 34 to rupture and open, such that the first component is directed from the storage chamber 26, through the first passageway 34 and into the mixing chamber 32. Preferably, the initial seal that initially closes the first chamber 26 to the first passageway 34 is relatively weak and can be opened by applying finger pressure to one or both of the sheets 22, 24 in areas extending over the first storage chamber 26.

Similarly, the storage chambers 28, 30 are also sealed around their entire periphery including an initial seal that initially extends across the adjacent entrance to the passageways 36, 38 respectively. The initial seal across the entrance to the passageways 36, 38 is preferably sufficiently weak so that it readily opens upon the application of finger pressure to the sheets 22, 24 in areas extending over the chambers 28, 30.

Preferably, the vent passageway 48 is initially open so that the mixing chamber 32 is always in communication with the atmosphere. As a consequence, the components can be urged from the chambers 26–30, along the passageways 34–38 and into the mixing chamber 32 without undue hindrance as might be otherwise observed if, for example, the pressure in the mixing chamber 32 increased to a relatively high amount and was not relieved. However, the vent passageway 48 has sufficient length and a sufficiently small cross-sectional area such that in most instances the components do not escape through the vent passageway 48 after the components are directed into the mixing chamber 32.

Figure 9:
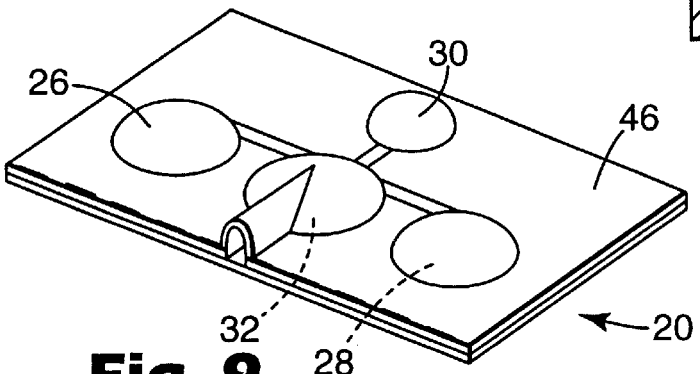
FIG. 9 is a reduced perspective view of the package illustrated in FIGS. 1–5, except that the package is shown as it might appear after passage through a channel in the actuator and after a front portion of the package has been detached.

When it is desired to dispense the composition from the mixing chamber 32, the package 20 is torn along the line of weakness 42 in order to detach the front portion 44 from the rear portion 46. Once the package 20 is torn in this manner, the forward or outlet end of the outlet passageway 40 is exposed and open as shown in FIG. 9, so that the composition can be expelled through the outlet passageway 40 as desired.

Optionally, the mixing chamber 32 may be compressed by finger pressure to expel the composition through the outlet passageway 40 to any desired location, such as onto a brush, swab, spatula or other tool, onto a mixing pad or other disposable sheet, or directly to the application site. As another option, the end of a brush, swab, spatula or other hand instrument may be inserted into the outlet passageway 40 and into the mixing chamber 32 for contact with the composition therein. If desired, the forward end of the hand instrument may be moved about the interior space of the mixing chamber 32 in order to further mix the components before withdrawing the composition from the mixing chamber 32.

The sheets 22, 24 may be made of any suitable material that is compatible with the stored components. An example of a suitable top sheet 22 is a composite material that includes a top polypropylene layer, an intermediate layer of aluminum foil and a bottom polyethylene layer. An example of a suitable material for the bottom sheet 24 is a composite material that includes a top layer of polyethylene, an intermediate layer of aluminum foil and a bottom layer of polyethylene terephthalate. Although reference is made in this application to "top" and "bottom" in connection with the sheets 22, 24, it should be understood in this regard that the manufacturer may prefer to turn the package 20 over for manufacturing operations as well as for distribution and sale. The bottom sheet 24 in this embodiment is flat and may provide a better location for carrying a label or for displaying instructions, brand name, catalog and lot numbers, expiration dates and the like.

Preferably, the sheets 22, 24 present a barrier to undue passage of air or water vapor. Optionally, one or both of the sheets 22, 24 substantially prevent the passage of actinic radiation but permit the passage of light in the visible spectrum, so that the user can observe the contents of the chambers 26–32 if desired. To this end, the sheets 22, 24 may be made of a translucent material to which a pigment has been added to block the actinic radiation.

One presently preferred composite material for the top sheet 22 is:

| Structure | Basis Wt. g/m$^2$ |
|---|---|
| oriented polyamide (25 microns) | 28.8 |
| adhesive lacquer | 3.5 |
| aluminum foil (60 microns) | 162.0 |
| adhesive lacquer | 1.5 |
| polypropylene (60 microns) | 54.0 |
| FDA-approved modified polypropylene heatseal coating | 3.5 |

One presently preferred material for the bottom sheet 24 is:

| Structure | Basis Wt. g/m$^2$ |
|---|---|
| stove lacquer | 1.3 |
| aluminum foil (20 microns) | 54.0 |
| FDA-approved heatseal coating | 3.5 |

The package 20 may be made by any suitable manufacturing technique. An example of one manufacturing technique includes the act of forming the top sheet 22 by placing a sheet of the composite material between a male and female die and closing the dies to stretch the material past its yield point in selected areas to form the chambers 26–32 and the passageways 34–40 and 48. This technique is known as a deep drawing technique or a cold forming technique. Next, the deep drawn top sheet 22 is placed over the bottom sheet 24, and the sheets 22, 24 are inserted between a pair of opposed platens. One or both of the platens are then heated in selected areas to bond the facing polyethylene layers of the sheets 22, 24 together, preferably in all areas of the package 20 except in areas of the chambers 26–30 and the passageways 34–40 and 48 (except as may be needed to establish an initial seal to the entrance of the passageways 34–38 ). Once the polyethylene layers are bonded together by the heated platens, the platens are cooled. After the package 20 has cooled, the package 20 is removed from the space between the platens.

A number of techniques are available for ensuring that the entrance to the passageways 34, 36, 38 can be readily opened when finger pressure is applied to the package in areas adjacent the chambers 26–32. For example, the platens as mentioned above may be constructed in such a manner that a somewhat lower platen temperature is provided in areas next to the passageway entrances in comparison to other areas where the polyethylene layers are securely bonded together when the platen is heated. As another option, the platens may be manufactured to establish a slight relief area so that there is less pressure on the sheets 22, 24 in areas adjacent the entrances to the passageways 34–38 in comparison to other areas of the package 20 where the polyethylene layers are securely bonded together. Other possible manufacturing techniques are described in Canadian patent application no. 2,244,628 filed Aug. 6, 1998, which is incorporated herein by reference in its entirety.

Other methods of bonding the top sheet 22 to the bottom sheet 24 include the use of radio frequency energy, induction sealing or impulse bonding processes. In those techniques, the energy can be directed to selected areas of the sheets 22, 24 in order to increase or decrease the bond strength as needed in accordance with the desired ultimate construction and arrangement of the package 20.

The package 20 may be used to mix and dispense any of a number of different compositions useful for various purposes. For example, the storage chambers 26, 28 may initially contain components of a two-part epoxy adhesive that are ideally separated from each other until immediately prior to use. In such applications, the package 20 is especially advantageous when included for sale in a container with other items such an emblem or hardware item, because the package 20 can be sized to contain an amount of resultant composition that is appropriate for use in mounting or otherwise affixing the emblem or hardware item in the container.

The package 20 is also especially advantageous for use with multiple-component dental compositions, because the package 20 can be sized to contain an amount suitable for a single use or for use with a single patient. As such, issues of cross-contamination between patients are avoided. An example of a suitable dental composition is a dental adhesive and etchant (or primer-etchant), where the adhesive is stored in one of the chambers (such as storage chamber 26) and the etchant (or primer-etchant) is stored in another chamber (such as storage chamber 28 ).

Advantageously, the provision of the third storage chamber 30 provides more options for the user and may be especially advantageous in particular instances. For example, the third storage chamber 30 may contain a component that can be used to alter the characteristics of the composition that results from mixing the components in the first and second chambers 26, 28. For instance, the third component 30 may be suitable for use in lowering the viscosity of the mixed composition as may be desired by a particular user or for a particular application at hand. In that instance, the user would have the option to eject substantially all or only a portion of the third component into the mixing chamber 32, so that any one of a number of different viscosities may be achieved in the resulting composition.

As an example, the chambers 26, 28 may contain components of an orthodontic bracket adhesive that begin to cure once mixed together. The third chamber 30 may contain a third component (such as a primer) that can be used to lower the viscosity of the adhesive composition resulting of the mixture of the first and second components if desired. Some orthodontists prefer relatively stiff orthodontic adhesives that help to prevent excessive movement of the bracket along the surface of the tooth until such time as the adhesive has cured. Other orthodontists prefer less stiff adhesives so that the bracket can be pressed close to the surface of the tooth with less effort. The provision of the third storage chamber 30 enables the orthodontist to choose whether or not a bracket adhesive having a relatively high viscosity or a relatively low viscosity is dispensed.

Another example of suitable compositions for the package 20 include dental adhesives, such as those described in U.S. Pat. Nos. 5,525,648 and 5,256,447 which are also expressly incorporated by reference herein. The storage chambers 26, 28 may be used to contain components of the adhesive that, when mixed together, begin to react with each other and ultimately cure. In that instance, the third storage chamber 30 may be optionally used to contain a component that includes a photoinitiator. If the photoinitiator is mixed with the other two components, a dual cure composition is attained. In this latter example, the user has the option of mixing only the first and second components to contain a single-cure material, or mixing all three components together to provide a dual-cure composition.

The third chamber 30 may be used to hold a component that might otherwise adversely affect the characteristics of either of the other two components over long periods of time during storage. For example, the third chamber 30 could contain a color-changing dye that serves to change the color of the adhesive after all three components are mixed together and cured. If the dye might impair the long-term storage characteristics of either component when mixed before placed in the package 20, the dye can instead be safely stored in the third chamber 30 where it does not contact the first or second components until the components are mixed together for use.

A variety of other compositions may be used as well. Examples include the compositions described in U.S. Pat. Nos. 5,130,347 and 5,154,762, both of which are expressly incorporated by reference herein. Moreover, one or more of the components may be a powder or tablet. Additionally, one of the components may be initially stored in the mixing chamber 32.

Figure 5:
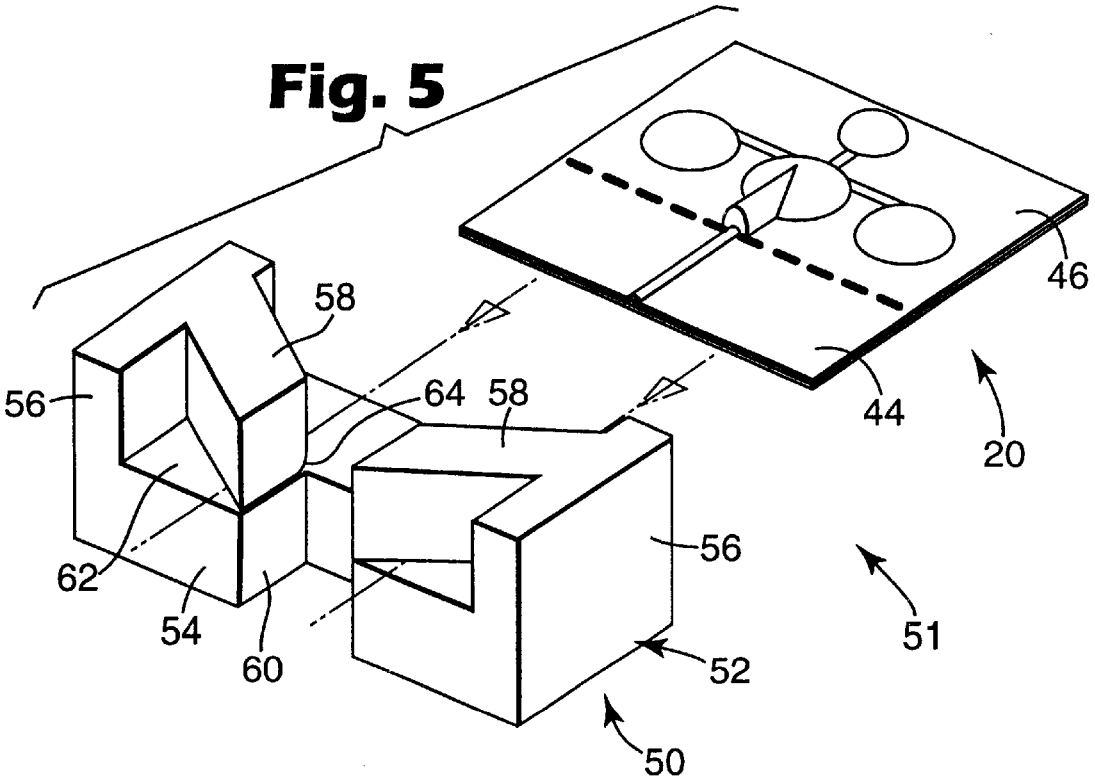
FIG. 5 is a reduced perspective view of the package shown in FIGS. 1–4 along with an actuator for mixing the components in the package.
Figure 6:
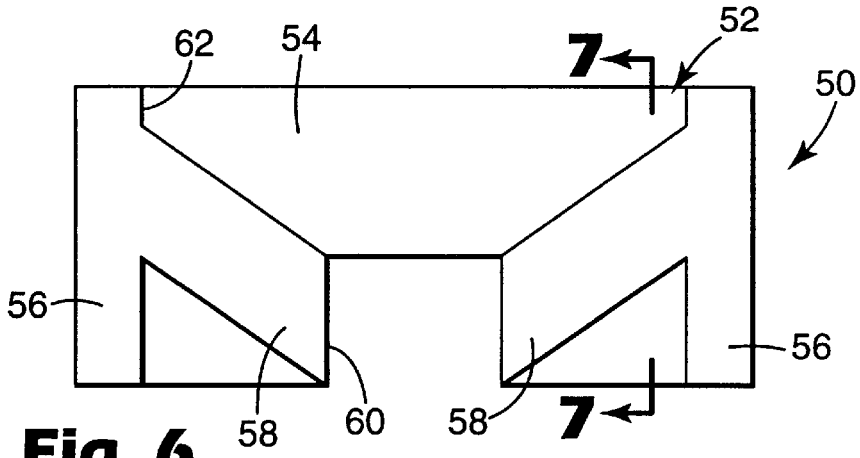
FIG. 6 is an enlarged plan view of the actuator alone that is depicted in FIG. 5.
Figure 8:
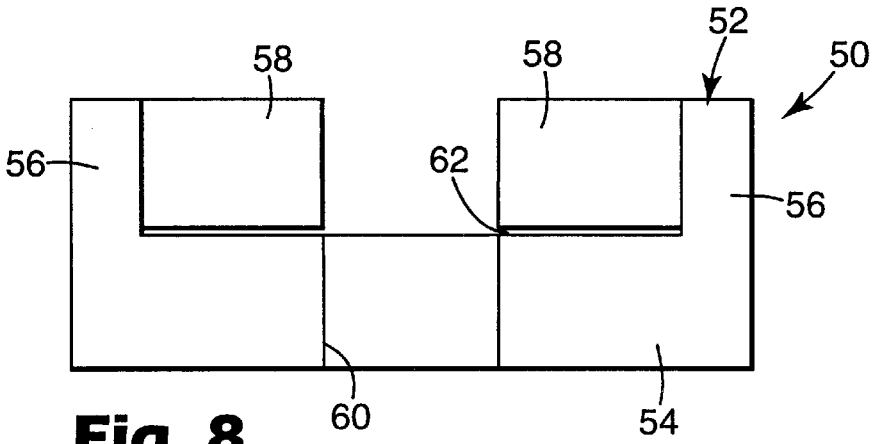
FIG. 8 is a front elevational view of the actuator shown in FIGS. 5–7.
Figure 7:
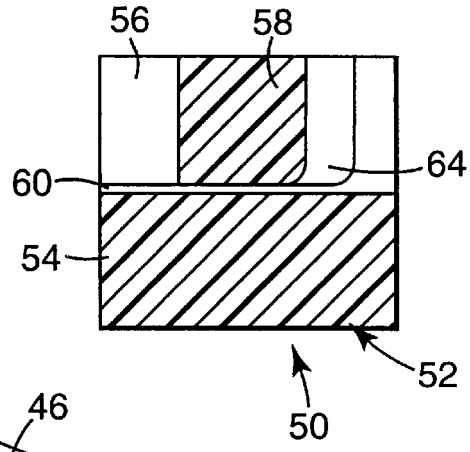
FIG. 7 is a side cross-sectional view of the actuator shown in FIGS. 5 and 6 and taken along lines 7—7 of FIG. 6.

An actuator 50 for use with the package 20 is shown in FIG. 5 and is also shown alone in FIGS. 6–8. The actuator 50 and the package 20 together comprise a dispensing assembly 51 (FIG. 5). The actuator 50 is comprised of a body 52 that includes a base portion 54 as well as a pair of upstanding end portions 56 that are connected to the base portion 54. The body 52 is preferably integrally made of a single unit. Suitable materials for the body 52 include plastics (such as polypropylene, polycarbonate or acrylonitrile-butadiene-styrene copolymer ("ABS") and metallic materials (such as aluminum or stainless steel alloys).

The body 52 also includes a pair of wall sections 58 that extend at an angle relative to the end portions 56 and to a channel 62 (described below). Examples of a suitable angle include angles in the range of about 5 degrees to about 40 degrees. Both of the wall sections 58 extend toward a front side of the body 52 and terminate immediately above side walls of a U-shaped notch 60 that is constructed in the base portion 54.

As shown for example in FIGS. 7 and 8, the body 52 includes a channel 62 that lies in a flat plane. The channel 62 extends in the direction of the arrows in FIG. 5 and is located above the top of the base portion 54, beneath the bottom of the wall sections 58 and between the end portions 56. A lower, leading corner edge 64 of each of the wall sections 58 is gently rounded as illustrated in FIGS. 5 and 7.

In use, the package 20 is placed into alignment with the channel 62 of the actuator 50 as depicted in FIG. 5. Next, the package 20 is moved in the direction of the arrows in FIG. 5 into the channel 62 until such time as the chambers 26, 28 come into contact with the rounded corner edge 64. Continued movement of the package 20 in the direction of the arrows shown in FIG. 5 will cause the wall sections 58 to simultaneously compress the chambers 26, 28. The rounded comer edge 64 facilitates compression of the chambers 26, 28 beneath the wall sections 58 and above the base portion 54 and helps to avoid tearing of the top sheet 22 during movement of the package along the channel 62.

As the storage chambers 26, 28 pass through the space between the wall sections 58 and the base portion 54, the pressure increases in the chamber 26, 28 until such time as the initial seal across the entrance of the passageways 34, 36 is opened. Once the passageways 34, 36 are opened, the first and second components are directed along the passageways 34, 36 and into the mixing chamber 32 where they come into contact with each other. As the first and second components are directed into the mixing chamber 32, the vent passageway 48 functions to relieve any excessive pressure in the mixing chamber 32.

The actuator 50 is an advantage, because the user is assured that the contents from both of the chambers 26, 28 are reliably moved into the mixing chamber 32 whenever the package 20 has passed through the channel 62. As such, the amount of the components that move from the chambers 26, 28 into the mixing chamber 32 as well as the ratio of 1 component to the other can be accurately predicted and the resultant, mixed composition will likely have the desired, expected properties. The actuator 50 avoids the need for the user to ensure that both of the chambers 26, 28 have been sufficiently flattened by proper application of finger pressure.

The notch 60 is useful for grasping the front portion 44 of the package 20 as the package 20 moves along the channel 62. The notch 60 is configured so that the front portion 44 can be grasped before such time as the chambers 26, 28 are located between the wall sections 58 and the base portion 54. In this manner, the user is able to easily retain a secure grasp on the package 20 during movement of the package 20 along the channel 62 so that the chambers 26, 28 can be compressed and pulled through the space between the wall sections 58 and the base portion 54.

Advantageously, the location of the notch 60 also functions to substantially hinder complete movement of the package 20 in a wrong direction along the channel 62. For example, if the user attempts to insert the front portion 44 of the package 20 into the channel 62 in a direction opposite than that which is indicated by the arrows in FIG. 5, the raised chambers 26, 28 will contact the front side of the wall sections 58 and prevent the front portion 44 from moving past the rear side of the body 52, making it difficult for the user to grasp the package 20 with sufficient strength to continue movement in that direction along the channel 62. The notch 60 also functions in a similar manner if, for example, the package 20 is inserted in the direction of the arrows in FIG. 5 but is instead turned around 180 degrees from its orientation shown in FIG. 5.

The inclination of the wall sections 58 relative to the end portions 56 and to the direction of movement of the package 20 in the channel 62 causes the components in the chambers 26, 28 to first shift to a rear portion of the respective chambers 26, 28 and then move along the corresponding passageways 34, 36. Preferably, once the package 20 has passed completely through the channel 62, substantially all of the components originally contained in the chambers 26, 28 has been directed through the respective passageways 34, 36 and into the mixing chamber 32. In this manner, relatively little of the components is wasted. Preferably, the width of the wall sections in a direction along the arrows shown in FIG. 5 is at least as great as the diameter of the chambers 26, 28 in order to reduce the possibility of substantial backflow of the components as the package 20 moves through the channel 62.

Moreover, the space between the adjacent ends of the wall sections 58 enables the third storage chamber 30 to remain uncompressed and in its original configuration as the package 20 passes through the channel 62. As a result, the user can choose whether or not to add the third component to the resulting composition. If a decision is made to add all or a portion of the third component to the mixing chamber 32, the third storage chamber 30 can be compressed by finger pressure either before or after such time as the package 20 is moved through the channel 62.

FIG. 9 is an illustration of the package 20 after the storage chambers 26, 28 have been compressed and the package 20 has been torn along the line of weakness 42. After the package 20 is torn in this manner, the front portion 44 is discarded and the rear portion of the package 46 is held during dispensing of the composition. Once the package 20 is torn along the line of weakness 42, the outlet of the outlet passageway 40 is open and the composition in the mixing chamber 32 can be dispensed as described above.

Figure 10:
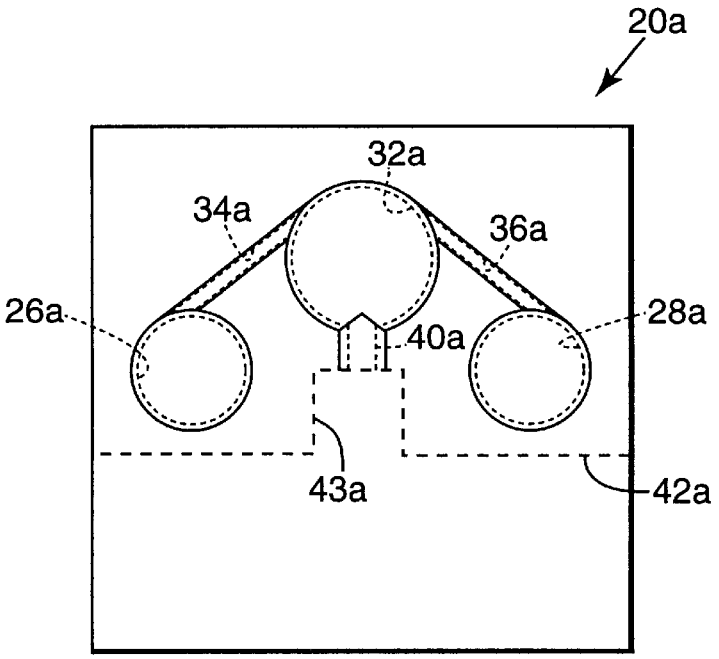
FIG. 10 is a plan view of a package for a multiple-component composition according to another embodiment of the invention.

A package 20*a* according to another embodiment of the invention is illustrated in FIG. 10. With the exception of the aspects described below, the package 20*a* is essentially the same as the package 20 and as such a detailed description of the common elements need not be repeated.

The package 20*a* includes a line of weakness 42*a* that, in this instance, does not extend along a straight path. Instead, the line of weakness 42*a* includes a U-shaped region 43*a* that extends past an outlet passageway 40*a*. The U-shaped region 43*a* of the line of weakness 42*a* is advantageous in some constructions where it is desired to shorten the length of the outlet passageway 40*a* in order to enhance access to a mixing chamber 32*a*. Such easier access is particularly desirable when using, for example, an applicator having a front end portion that extends at an angle relative to a handle of the applicator.

The package 20*a* also includes two storage chambers 26*a*, 28*a* and two passageways 34*a*, 36*a*. The storage chambers 26*a*, 28*a* and the passageways 34*a*, 36*a* are arranged somewhat differently than the chambers 26, 28 and the passageways 34, 36 of the package 20 as can be appreciated by comparison of FIG. 10 to FIG. 2. The passageways 34*a*, 36*a* are connected to a mixing chamber 32*a* that, in turn, is connected to the outlet passageway 40*a*. The package 20*a* as illustrated in FIG. 10 does not include a third storage chamber or a third passageway but such features can be added if desired.

Figure 11:
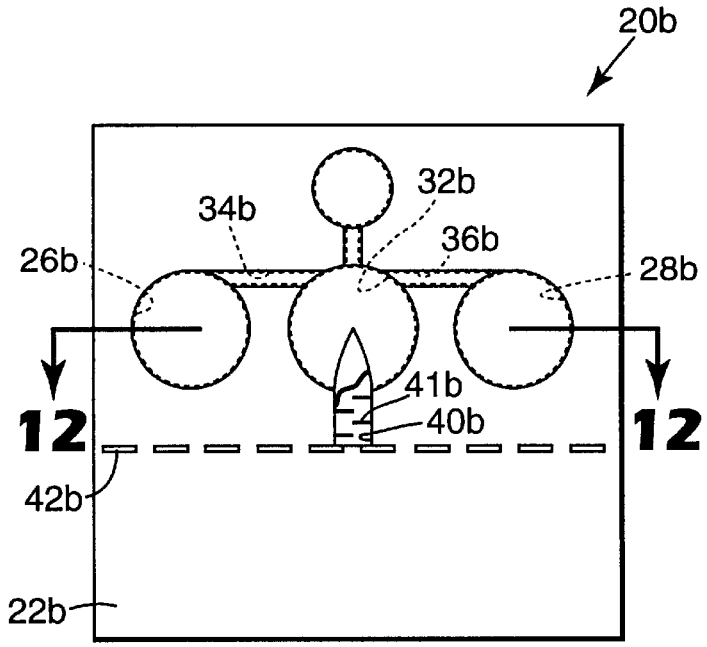
FIG. 11 is a plan view of a package for a multiple-component composition according to yet another embodiment of the invention.
Figure 12:
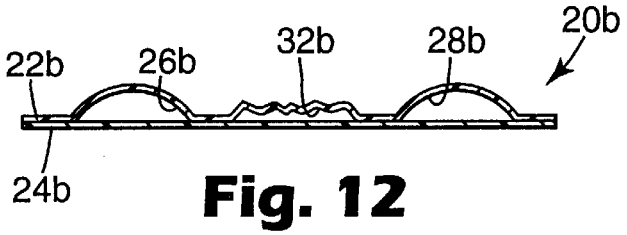
FIG. 12 is a cross-sectional view of the package shown in FIG. 11 and taken along lines 12—12 of FIG. 11.

A package 20*b* for a multiple-component composition according to another embodiment of the invention is illustrated in FIGS. 11 and 12. The package 20*b* is essentially the same as the package 20 except for the differences noted below. As with the package 20 as described above, the top sheet is formed by stretching the material of the top sheet past its yield point in selected areas to form and define the chambers 26*b*, 28*b*, 32*b* and passageways 34*b*, 36*b*.

The package 20*b* does not include a vent passageway (such as the vent passageway 48 in package 20 ). The package 20*b* has a mixing chamber 32*b* that is compressed by the manufacturer to a somewhat flattened configuration (see FIG. 12) after initially drawn into a dome-shaped chamber configuration. The mixing chamber 32*b* is collapsed by the manufacturer before the mixing chamber 32*b* is closed (sealed) to the atomsphere.

When it is desired to mix the components, pressure is applied to first and second storage chambers 26*b*, 28*b* using either manual (i.e., finger or thumb) pressure or an actuator such as the actuator 50 described above. As the first and second components are moved along first and second passageways 34*b*, 36*b*, the initially compressed top of the mixing chamber 32*b* begins to shift upwardly and expand the volume of the mixing chamber 32*b*. By initially collapsing the sheet over the mixing chamber 32*b*, the mixing chamber 32*b* can be expanded when needed to accommodate the incoming streams of the first and second components. As a consequence, pressure in the mixing chamber 32*b* does not unduly increase and the need for a vent passageway is avoided.

Optionally, an outlet passageway 40*b* of the package 20*b* includes a static mixer 41*b*, as illustrated in the cut-away section shown in FIG. 11. In this instance, the static mixer 41*b* comprises a spaced apart series of wall segments that provide a tortuous path for the composition as the composition passes from the mixing chamber 32*b*. The tortuous path helps to ensure that the components are thoroughly recombined and mixed before discharge from the outlet of the outlet passageway 40*b*.

The static mixer 41*b* may be made by forming indentations, bumps or protrusions on one or both of the sheets 22*b*, 24*b*. As another option, the static mixer 41*b* may be a separate element that is inserted into the outlet passageway 40*b* before the sheets 22*b*, 24*b* are bonded together. As an additional option, the static mixer may be in the shape of a nozzle that is initially separate from the package 20*b*, but is inserted into the space of the outlet passageway 40*b* when needed (such as after the package 20*b* is torn along the line of weakness 42*b*).

Figure 13:
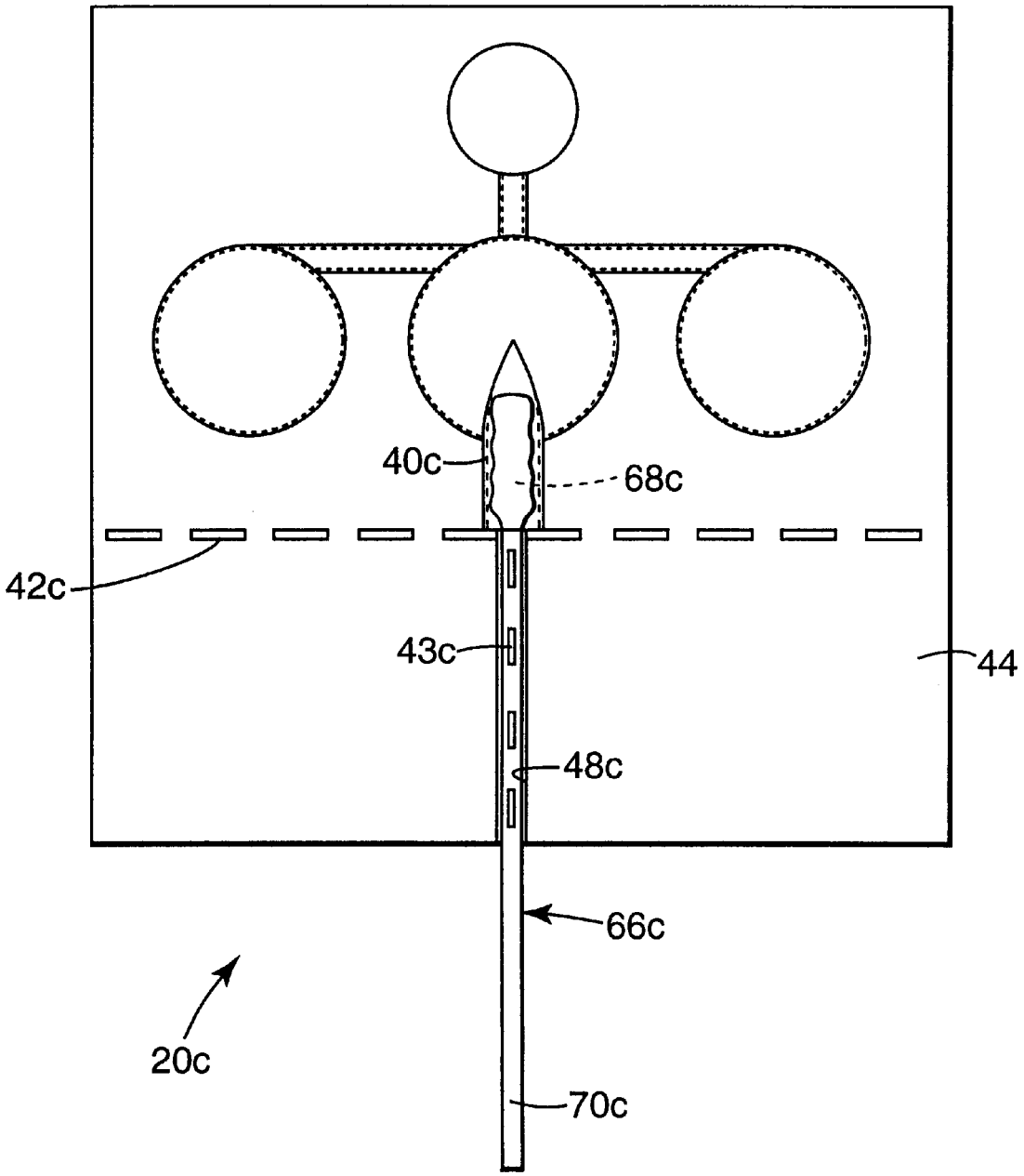
FIG. 13 is a plan view of a package for a multiple-component composition according to still another embodiment of the invention.

Another embodiment of the invention is shown in FIG. 13. In FIG. 13, a package 20*c* is illustrated and is essentially the same as the package 20 described above, except for the differences that are mentioned below.

The package 20*c* includes an applicator 66*c* having a head 68*c* and a handle 70*c*. The head 68*c* is received in an outlet passageway 40*c*, while the handle 70*c* is received in a passageway 48*c*. The need for an additional or separate vent passageway is avoided, since there is sufficient space between the handle 70*c* and the walls defining the passageway 48*c* to provide relief of any pressure as may be needed during mixing of the components. Preferably, an additional line of weakness 43*c* is provided over the handle 70*c* to facilitate removal of the applicator 66*c*.

The head 68*c* may have any one of a number of different constructions, and may be selected according to the intended use of the mixed composition. For example, the head 68*c* may be a brush or swab, or have a spatula-type configuration. As another option, the head 68*c* may be a bulb-shaped section that is flocked with a plurality of small fibers, such as the flocked applicators provided by Microbrush Corporation of Clearwater, Fla.

Optionally, the applicator 66*c* is made of a unitary plastic member that is preferably low in cost. As an additional option, the applicator 66*c* may include a bendable region in the area of the handle 70*c* near the head 68*c* or in the area between the handle 70*c* and the head 68*c*. In that instance, the user will be able to bend the head 68*c* relative to the handle 70*c* to any particular configuration in order to facilitate application of the composition to a selected work area.

As shown in FIG. 13, the configuration of the outlet passageway 40*c* and the passageway 48*c* relative to the shape of the applicator 66*c* ensures that the applicator 66*c* will stay in place in the package 20*c* until needed. Once the package 20*c* is torn along the lines of weakness 42*c*, 43*c*, the applicator can be removed for use in applying the composition to the application site. The head 68*c* of the applicator 66*c* may be shifted within the mixing chamber 32*c* in order to further mix the components as desired.

Figure 14:
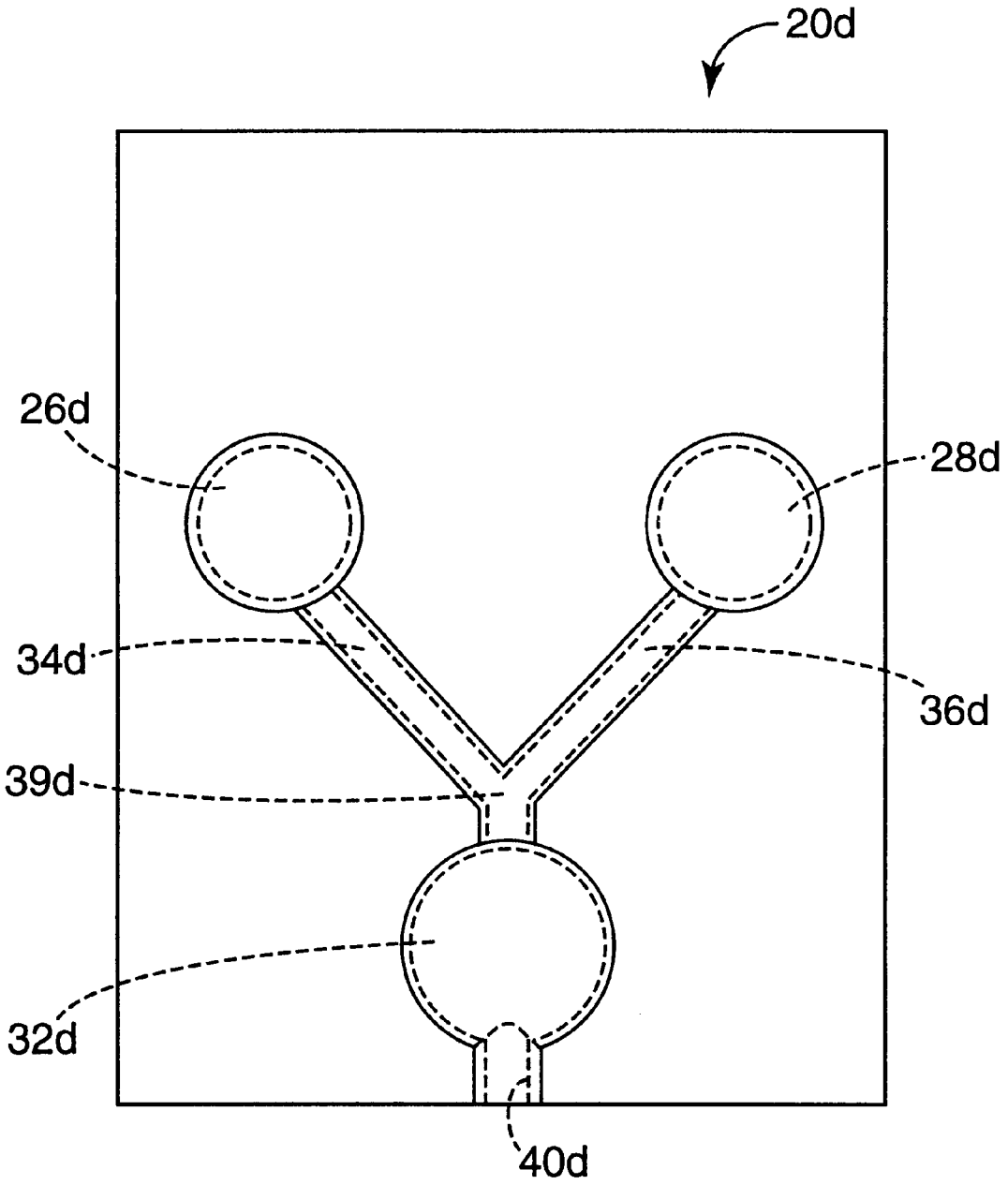
FIG. 14 is a plan view of a package for a multiple-component composition according to an additional embodiment of the invention.

FIG. 14 illustrates a package 20*d* according to an additional embodiment of the invention. The package 20*d* is essentially the same as the package 20 described above, except for the differences that are set out below.

The package 20*d* includes a first storage chamber 26*d*, a second storage chamber 28*d* and a mixing chamber 32*d*. In addition, the package 20*d* includes a first passageway 34*d* that extends between the first storage chamber 26*d* and a mixing chamber 32*d*. The package 20*d* also includes a second passageway 36*d* that extends between the second storage chamber 28*d* and the mixing chamber 32*d*. Like the packages 20*a*, 20*b* and 20*c*, the mixing chamber 32*d* of the package 20*d* is located along a reference axis (not shown) that extends between the first passageway, 34*d* and the second passageway 36*d*.

The passageways 36*d*, 38*d* join together at a junction that is located upstream of the mixing chamber 32*d*. In FIG. 14, the junction is designated by the numeral 39*d*. In the region where the passageways 36*d*, 38*d* are joined together (i.e., in the region extending from the junction 39*d* to the mixing chamber 32*d*), the first and second components contact each other and mix as they move toward the mixing chamber 32*d*. As a result, the region between the junction 39*d* and the mixing chamber 32*d* provides a pre-mix zone for the components, to further facilitate thorough mixing of the components before such time and the components are expelled from the package 20*d*. Optionally, structure could be added to the pre-mix zone of the passageways 36*d*, 38*d* where joined together to serve as a static mixer and enhance intermixing of the components.

Other aspects of the package 20*d* are similar to the packages described above. For example, an initial seal extending around the periphery of the storage chambers 28*d*, 30*d* is provided and the package 20*d* is constructed using one or two sheets of flexible material. Moreover, the package 20*d* may be provided with a third storage chamber if desired. Also, the package 20*d* could be used in connection with an actuator similar to the actuator 50.

Additionally, the package 20*d* may optionally include a front portion and a rear portion, with a line of weakness between the front and rear portions. The line of weakness can extend across the outlet passageway 40*d* if desired. For example, the package 20*d* could have a detachable front portion that is initially connected by a line of weakness to the lower edge of the package 20*d* when oriented as shown in FIG. 14. Furthermore, the package may include a brush, swab, spatula or other tool, such as the applicator 66*c* described above. If desired, the length of the package 20*d* may be enlarged to provide an additional area for support of an applicator.

The embodiments that are described above represent currently preferred embodiments of the invention. Those skilled in the art will recognize that a number of modifications and additions may be made to the embodiments described above without departing from the spirit of the invention. Accordingly, the invention should not be deemed limited to the specific embodiments described in detail, but instead only by a fair scope of the claims that follow along with their equivalents.

What is claimed is:

1. A package for a multiple-component composition comprising:

a first sheet;

a second sheet connected to the first sheet, wherein at least one of the sheets is made of a flexible material;

a first chamber, a second chamber and a mixing chamber, wherein each of the chambers is located between the first sheet and the second sheet;

an outlet passageway connected to the mixing chamber;

a first passageway extending from the first chamber to the mixing chamber;

a second passageway extending from the second chamber to the mixing chamber, wherein the mixing chamber is located along a reference axis that extends between the first passageway and the second passageway;

a line of weakness extending adjacent the outlet passageway; and a vent passageway extending from the outlet passageway to the atmosphere, and wherein the line of weakness is located between the outlet passageway and the vent passageway.

2. A package for a multiple-component composition comprising:

a first sheet;

a second sheet connected to the first sheet, wherein at least one of the sheets is made of a flexible material;

a first chamber for receiving a first component, a second chamber for receiving a second component and a mixing chamber, wherein each of the chambers is located between the first sheet and the second sheet;

an outlet passageway connected to the mixing chamber;

a first passageway extending from the first chamber to the mixing chamber;

a second passageway extending from the second chamber to the mixing chamber, wherein the mixing chamber is located along a reference axis that extends between the first passageway and the second passageway; and an actuator comprising a body with a channel for receiving the package, the body including wall sections for compressing the first chamber and the second chamber as the package is received in the channel in order to direct the first component and the second component into the mixing chamber.

3. A package for a multiple-component composition according to claim 2 wherein the actuator includes structure for hindering grasping of the package in order to pull the package through the channel unless the package is oriented in a certain direction relative to the actuator.

4. A package for a multiple-component composition comprising:

a first sheet;

a second sheet connected to the first sheet, wherein at least one of the sheets is made of a flexible material;

a first chamber, a second chamber and a mixing chamber, wherein each of the chambers is located between the first sheet and the second sheet;

an outlet passageway connected to the mixing chamber;

a first elongated passageway extending from the first chamber to the mixing chamber;

a second elongated passageway extending from the second chamber to the mixing chamber, wherein the first passageway and the second passageway each have a generally constant width along their length, and wherein the mixing chamber is located along a reference axis that extends between the first passageway and the second passageway; and wherein the mixing chamber is defined at least in part by a material that has been stretched past its yield point and also collapsed.

5. A package for a multiple-component composition comprising:

a first sheet;

a second sheet connected to the first sheet, wherein at least one of the sheets is made of a flexible material that has been stretched past its yield point in selected areas;

a first chamber, a second chamber and a mixing chamber, wherein each of the chambers is located between the first sheet and the second sheet and has been formed by the selected areas;

an outlet passageway connected to the mixing chamber;

a first elongated passageway extending from the first chamber to the mixing chamber;

a second elongated passageway extending from the second chamber to the mixing chamber, wherein the first passageway and the second passageway each have a generally constant width along their length, and wherein the mixing chamber is located along a reference axis that extends between the first passageway and the second passageway;

a first component of the composition received in the first chamber; and a second component of the composition received in the second chamber.

6. A package for a multiple-component composition comprising:

a first sheet;

a second sheet connected to the first sheet, wherein at least one of the sheets is made of a flexible material that has been stretched past its yield point in selected areas;

a first chamber, a second chamber and a mixing chamber, wherein each of the chambers is located between the first sheet and the second sheet and has been formed by the selected areas;

an outlet passageway connected to the mixing chamber;

a first elongated passageway extending from the first chamber to the mixing chamber;

a second elongated passageway extending from the second chamber to the mixing chamber, wherein the first passageway and the second passageway each have a generally constant width along their length, and wherein the mixing chamber is located along a reference axis that extends between the first passageway and the second passageway;

and including an additional chamber along with an additional passageway extending between the additional chamber and the mixing chamber.

7. A package for a multiple-component composition according to claim 6 and including a first component of the composition received in the first chamber, a second component of the composition received in the second chamber and a third component of the composition received in the additional chamber.

8. A package for a multiple-component composition comprising:

a first sheet;

a second sheet connected to the first sheet, wherein at least one of the sheets is made of a flexible material and includes a line of weakness;

a first chamber, a second chamber and a mixing chamber, wherein each of the chambers is located between the first sheet and the second sheet;

an outlet passageway connected to the mixing chamber;

a first passageway extending from the first chamber to the mixing chamber;

a second passageway extending from the second chamber to the mixing chamber, wherein the mixing chamber is located along a reference axis that extends between the first passageway and the second passageway; and an applicator located at least partially between the first sheet and the second sheet, wherein the applicator includes a head and a handle, and wherein the line of weakness extends across the handle.

9. A package for a multiple-component composition according to claim 8 wherein the applicator includes a head that is located at least in part in the outlet passageway.

10. A package for a multiple-component composition comprising:

a first sheet;

a second sheet connected to the first sheet, wherein at least one of the sheets is made of a flexible material;

a first chamber, a second chamber and a mixing chamber, wherein each of the chambers is located between the first sheet and the second sheet;

an outlet passageway connected to the mixing chamber;

a first elongated passageway extending from the first chamber to the mixing chamber; and a second elongated passageway extending from the second chamber to the mixing chamber, wherein the first passageway and the second passageway are spaced from each other, are located on opposite sides of the mixing chamber and extend in opposite directions toward the mixing chamber.

11. A package for a multiple-component composition according to claim 10 wherein the package include a line of weakness extending adjacent the outlet passageway.

12. A package for a multiple-component composition comprising:

a first sheet;

a second sheet connected to the first sheet, wherein at least one of the sheets is made of a flexible material;

a first chamber, a second chamber and a mixing chamber, wherein each of the chambers is located between the first sheet and the second sheet:

an outlet passageway connected to the mixing chamber;

a first passageway extending from the first chamber to the mixing chamber;

a second passageway extending from the second chamber to the mixing chamber, wherein the first passageway and the second passageway are spaced from each other;

a line of weakness extending adjacent the outlet passageway; and a vent passageway extending from the outlet passageway to the atmosphere, and wherein the line of weakness is located between the outlet passageway and the vent passageway.

13. A package for a multiple-component composition comprising:

a first sheet;

a second sheet connected to the first sheet, wherein at least one of the sheets is made of a flexible material;

a first chamber for receiving a first component, a second chamber for receiving a second component and a mixing chamber, wherein each of the chambers is located between the first sheet and the second sheet;

an outlet passageway connected to the mixing chamber;

a first passageway extending from the first chamber to the mixing chamber;

a second passageway extending from the second chamber to the mixing chamber, wherein the first passageway and the second passageway are spaced from each other; and an actuator comprising a body with a channel for receiving the package, the body including wall sections for compressing the first chamber and the second chamber as the package is received in the channel in order to direct the first component and the second component into the mixing chamber.

14. A package for a multiple-component composition according to claim 13 wherein the actuator includes structure for hindering grasping of the package in order to pull the package through the channel unless the package is oriented in a certain direction relative to the actuator.

15. A package for a multiple-component composition according to claim 10 wherein the mixing chamber is defined at least in part by a material that has been stretched past its yield point and also collapsed.

16. A package for a multiple-component composition according to claim 10 and including a first component of the composition received in the first chamber and a second component of the composition received in the second chamber.

17. A package for a multiple-component composition according to claim 10 and including an additional chamber along with an additional passageway extending between the additional chamber and the mixing chamber.

18. A package for a multiple-component composition according to claim 17 and including a first component of the composition received in the first chamber, a second component of the composition received in the second chamber and a third component of the composition received in the additional chamber.

19. A package for a multiple-component composition comprising:

a first sheet;

a second sheet connected to the first sheet, wherein at least one of the sheets is made of a flexible material and includes a line of weakness;

a first chamber, a second chamber and a mixing chamber, wherein each of the chambers is located between the first sheet and the second sheet;

an outlet passageway connected to the mixing chamber;

a first passageway extending from the first chamber to the mixing chamber;

a second passageway extending from the second chamber to the mixing chamber, wherein the first passageway and the second passageway are spaced from each other; and an applicator located at least partially between the first sheet and the second sheet, wherein the applicator includes a head and a handle, and wherein the line of weakness extends across the handle.

20. A package for a multiple-component composition comprising:

a first sheet;

a second sheet connected to the first sheet in overlying relation, wherein at least one of the sheets is made of a flexible material;

a first chamber, a second chamber and a mixing chamber, wherein each of the chambers is located between the first sheet and the second sheet;

a first passageway connecting the first chamber to the mixing chamber;

a second passageway connecting the second chamber to the mixing chamber;

an outlet passageway extending from the mixing chamber; and a vent passageway extending from the outlet passageway to the atmosphere, wherein at least one of the first sheet and the second sheet includes a line of weakness that extends along a path between the vent passageway and the outlet passageway, and wherein the vent passageway has a cross-sectional area that is less than the cross-sectional area of the outlet passageway.

21. A package for a multiple-component composition according to claim 20 wherein the vent passageway is initially open to the atmosphere for communicating the mixing chamber with the atmosphere.

22. A package for a multiple-component composition comprising:

a first sheet;

a second sheet connected to the first sheet in overlying relation, wherein at least one of the sheets is made of a flexible material;

a first chamber for receiving a first component, a second chamber for receiving a second component and a mixing chamber, wherein each of the chambers is located between the first sheet and the second sheet;

a first passageway connecting the first chamber to the mixing chamber;

a second passageway connecting the second chamber to the mixing chamber;

an outlet passageway extending from the mixing chamber;

a vent passageway extending from the outlet passageway to the atmosphere, wherein at least one of the first sheet and the second sheet includes a line of weakness that extends along a path between the vent passageway and the outlet passageway, and wherein the vent passageway has a cross-sectional area that is less than the cross-sectional area of the outlet passageway; and an actuator comprising a body with a channel for receiving the package, the body including wall sections for compressing the first chamber and the second chamber as the package is received in the channel in order to direct the first component and the second component into the mixing chamber.

23. A package for a multiple-component composition according to claim 20 wherein the actuator includes structure for hindering grasping of the package in order to pull the package through the channel unless the package is oriented in a certain direction relative to the actuator.

24. A package for a multiple-component composition according to claim 20 wherein the mixing chamber is defined at least in part by a material that has been stretched past its yield point and also collapsed.

25. A package for a multiple-component composition according to claim 20 and including a first component of the composition received in the first chamber and a second component of the composition received in the second chamber.

26. A package for a multiple-component composition according to claim 20 and including an additional chamber along with an additional passageway extending between the additional chamber and the mixing chamber.

27. A package for a multiple-component composition according to claim 26 and including a first component of the composition received in the first chamber, a second component of the composition received in the second chamber and a third component of the composition received in the additional chamber.

28. A package for a multiple-component composition according to claim 20 and including an applicator located at least partially between the first sheet and the second sheet.

29. A package for a multiple-component composition according to claim 28 wherein the applicator includes a head that is located at least in part in the outlet passageway.

30. A package for a multiple-component composition comprising:

a first sheet;

a second sheet connected to the first sheet in overlying relation, wherein at least one of the sheets is made of a flexible material;

a first chamber, a second chamber and a mixing chamber, wherein each of the chambers is located between the first sheet and the second sheet;

a first passageway connecting the first chamber to the mixing chamber;

a second passageway connecting the second chamber to the mixing chamber;

a first component received in the first chamber; and a second component received in the second chamber, wherein at least one of the first sheet and the second sheet is stretched past its yield point in areas next to the mixing chamber and is also initially collapsed in at least some of the same areas when the first component and the second component are received in the first chamber and the second chamber respectively, in order to facilitate passage of the first component and the second component along the first passageway and the second passageway respectively and into the mixing chamber.

31. A package for a multiple-component composition according to claim 30 and including an additional chamber along with an additional passageway extending between the additional chamber and the mixing chamber.

32. A package for a multiple-component composition according to claim 30 and including an applicator located at least partially between the first sheet and the second sheet.

33. A package for a multiple-component composition according to claim 32 wherein the applicator includes a head that is located at least in part in the outlet passageway.

34. A dispensing assembly comprising:

a package for a multiple-component composition including a first sheet and a second sheet connected to the first sheet in overlying relation, wherein at least one of the sheets is made of a flexible material, the package also including a first chamber, a first component received in the first chamber, and second chamber, a second component received in the second chamber and a mixing chamber, each of the chambers being located between the first sheet and the second sheet, the package also including a first passageway connecting the first chamber to the mixing chamber, a second passageway connecting the second chamber to the mixing chamber and an outlet passageway connected to the mixing chamber; and an actuator comprising a body with a channel for receiving the package, the body including wall sections for compressing the first chamber and the second chamber as the package is received in the channel in order to direct the first component and the second component into the mixing chamber.

35. A dispensing assembly according to claim 34 wherein the wall sections extend at an angle relative to the direction of movement of the package as the package is moved along the channel.

36. A dispensing assembly according to claim 34 wherein the body includes a notch for facilitating grasping of the package.

37. A dispensing assembly according to claim 36 wherein the actuator and the package are constructed to hinder grasping of the package in order to pull the package through the channel unless the package is oriented in a certain direction relative to the actuator.

38. A dispensing assembly according to claim 34 wherein the package includes a line of weakness that extends along a path adjacent the outlet passageway.

39. A dispensing assembly according to claim 34 wherein the package includes an applicator that is located at least partially between the first sheet and the second sheet.

40. A dispensing assembly according to claim 34 wherein at least one of the first sheet and the second sheet is stretched past its yield point and is also initially collapsed in areas next to the mixing chamber.

41. A dispensing assembly according to claim 34 and including an additional chamber along with an additional passageway extending between the additional chamber and the mixing chamber.

* * * * *

UNITED STATES PATENT AND TRADEMARK OFFICE

CERTIFICATE OF CORRECTION

PATENT NO. : 6,612,769 B2
DATED : September 2, 2003
INVENTOR(S) : Lee, Robert

It is certified that error appears in the above-identified patent and that said Letters Patent is hereby corrected as shown below:

Title page,
Item [73], Assignee, "Innovative Properties Company" should be -- 3M Innovative Properties Company --.

Signed and Sealed this

Twenty-fifth Day of May, 2004

JON W. DUDAS
*Acting Director of the United States Patent and Trademark Office*